US006267617B1

(12) United States Patent
Nozick

(10) Patent No.: US 6,267,617 B1
(45) Date of Patent: Jul. 31, 2001

(54) LOW VOLTAGE PLUG ADAPTER WITH ORGANIZING REAR BONNET

(75) Inventor: Jacques Nozick, Paris (FR)

(73) Assignee: Infra, L'Hay les Roses ( * ) Notice: Subject to any disclaimer, the term of this patent is extended or adjusted under 35 U.S.C. 154(b) by 0 days.

(21) Appl. No.: 09/508,962

(22) PCT Filed: Sep. 18, 1998

(86) PCT No.: PCT/FR98/02004

§ 371 Date: May 19, 2000

§ 102(e) Date: May 19, 2000

(87) PCT Pub. No.: WO99/16153

PCT Pub. Date: Apr. 1, 1999

(30) Foreign Application Priority Data

Sep. 22, 1997 (FR) ..... 97 11763

(51) Int. Cl.[7] ..... H01R 4/24

(52) U.S. Cl. ..... 439/417; 439/676; 439/456; 439/404

(58) Field of Search ..... 431/417, 409, 431/456, 676, 395, 404

(56) References Cited

U.S. PATENT DOCUMENTS 5,041,009 * 8/1991 McCleerey ..... 439/417
5,071,366 12/1991 Bernardini ..... 439/417
5,305,547 * 4/1994 Weiss ..... 439/417
5,957,720 * 9/1999 Boudin ..... 439/417

FOREIGN PATENT DOCUMENTS 295 12 585 U 1/1996 (DE) .
057 579 8/1982 (EP) .
650 218 4/1995 (EP) .
654 867 5/1995 (EP) .
700 126 3/1996 (EP) .
2562337 * 10/1995 (FR) ..... 439/417

* cited by examiner

*Primary Examiner*—Tho D. Ta
(74) *Attorney, Agent, or Firm*—Sughrue, Mion, Zinn, Macpeak & Seas, PLLC

(57) ABSTRACT

The present invention relates to a low-current outlet comprising: an outlet base (2) provided with contact pins (25) to which a plug can be connected by engaging it along a given plug-in axis; and an organizer cap (1) that can be mounted on the outlet base (2), which cap (1), on being fixed to the base, establishes the electrical contact between the conductor wires (31, 32) of a connection cable (3) and the contact pins (25) of the base (2), the cap (1) being provided with wire guides (11, 12) making it possible to position the wires (31, 32) in three dimensions repetitively and separately so that they are connected electrically to the contact pins (25) on fixing the cap (1) to the base (2); said low-current outlet being characterized in that the cap (1) can be mounted onto the low-current outlet (2) from the rear and along said plug-in axis.

9 Claims, 3 Drawing Sheets

LOW VOLTAGE PLUG ADAPTER WITH ORGANIZING REAR BONNET

The present invention relates to a low-current outlet for use in computing or in telephony. Such an outlet, e.g. of the RJ45 type, generally comprises an outlet base provided with a pluggable socket containing a plurality of (usually eight) contact pins. By means of a plug, it is possible to connect to the contact pins. Naturally, the pluggable socket is situated at the front of the outlet. At the rear of the outlet, a connection cable is generally connected to insulation-displacement contacts which are naturally angularly positioned perpendicularly to the conductor wires on which the insulation is to be cut and displaced.

In order to connect the conductor wires of the connection cable, devices exist for stowing and organizing said wires and for fixing them to the insulation-displacement contacts of the outlet base. In general, such a device are in the form of a cap that can be mounted on the outlet base. A typical example of an organizer cap is in the form of a comb through which the conductor wires of the connection cable are caused to pass. The comb consists of an aligned row of wire feed-through channels disposed side by side. Therefore, it is relatively difficult and laborious to thread the wires into their respective wire feed-through channels because it is almost obligatory to thread all of the wires in the same operation. The conductor wires must therefore be disposed side-by-side in aligned manner in a precise order that is distinguished by different wire colors. The operator in charge of connecting the connection cable to the outlet in question must therefore perform this laborious positioning task before it is possible to insert the wires into the organizer cap. Once this complicated operation has been performed, the organizer cap is mounted laterally onto the insulation-displacement contacts of the outlet base by exerting a push force on the cap so as to engage the wires into the respective insulation-displacement contacts. Once the organizer cap has been pushed in to its maximum engagement position, it is guaranteed that the insulation on all of the conductor wires will have been cut through to the cores of the wires by the insulation-displacement contacts. The conductor wires are thus wired simultaneously.

As mentioned above, the use of such organizer caps is relatively laborious because of the difficulty encountered in threading all of the conductor wires into their respective wire feed-through channels. In addition, it should be noted that the cap configuration in the form of a comb having wire feed-through channels in parallel alignment causes any traction applied to the connection cable or to the outlet to be exerted directly on the cores of the conductor wires wedged in the insulation-displacement contacts. Any high traction applied to the cable or to the outlet causes the cores of the wires to slide in the insulation-displacement contacts, or even causes the conductor wires to be severed.

That problem can be encountered in particular in the outlet described in Document EP-0 735 612. That outlet conventionally comprises an outlet base and an organizer cap. The outlet base is provided with two rows of four insulation-displacement contacts which point upwards, when the outlet is positioned as it is to be installed in a wall. The two rows of contacts are offset vertically and horizontally one relative to the other, so that they are disposed in the manner of terraces. In addition, the cap also defines two rows of guide holes for the eight wires from the cable to be connected. The two rows of four holes open out in offset manner so that it is possible to insert the wires into the insulation-displacement contacts of the outlet base. In that outlet, as in the conventional outlets of the prior art, the cap is mounted onto the base laterally, i.e. perpendicularly to the plug-in axis along which the outlet is plugged. As a result, it suffers from the above-mentioned problem of the wires being torn out when traction is applied to the cable because they extend substantially rectilinearly to the outlet.

An object of the present invention is to remedy the above-mentioned drawbacks of the prior art by defining a low-current outlet having an organizer cap with which it is simpler to install the various conductor wires, and in which the connection performed by the organizer cap is stronger in that any traction applied to the cable is not passed on to the cores of the wires engaged in the insulation-displacement contacts.

For this purpose, the present invention provides a low-current outlet comprising:

an outlet base provided with contact pins to which a plug can be connected by engaging it along a given plug-in axis; and an organizer cap that can be mounted on the outlet base, which cap, on being fixed to the base, establishes the electrical contact between the conductor wires of a connection cable and the contact pins of the base, the cap being provided with wire guides making it possible to position the wires in three dimensions repetitively and separately so that they are connected electrically to the contact pins on fixing the cap to the base;

said low-current outlet being characterized in that the cap can be mounted onto the low-current outlet from the rear and along said plug-in axis.

Unlike prior art outlets in which the cable, which always comes from the rear of the outlet, is mounted laterally into the outlet base by means of the organizer cap, in the present invention, the cable is brought into the outlet base in the same direction as the insulation-displacement contacts, which requires folding or changing the direction of the wires in the organizer cap so as to bring them perpendicular to the insulation-displacement contacts.

Advantageously, each wire guide serves to guide one pair of wires, said guides being disposed in a polygonal geometrical configuration. Thus with the organizer cap of the invention, the various conductor wires are installed in pairs in the organizer cap, which greatly facilitates this operation. In general, there are four of said wire-pair guides for a conventional cable comprising four pairs of wires, and they are disposed in a rectangular configuration. Thus, the various pairs of conductor wires are separated in three dimensions.

According to an advantageous characteristic, each wire-pair guide comprises a common guide duct that is common to the pair of wires, and two locking channels for respective ones of the wires of the pair. In which case, the common guide ducts may extend substantially along said plug-in axis, and the locking channels may extend substantially perpendicularly to said plug-in axis.

As a result, the common guide duct and each of the two locking channels make an angle such as to form an edge on which the respective wire forms a locking fold. Thus, the conductor wires can be firstly pulled fully through the common guide duct, and then folded over into their respective locking channels, thereby forming the locking folds at the edges that form the transitions between the common guide duct and the respective locking channels. The locking folds guarantee firstly that the wires are pulled fully through the organizer cap so that the shielding of the connection cable or of the individual pairs of wires extends to as close as possible to the organizer cap, and secondly that the wires are held stationary permanently in the organizer cap. The locking folds thus perform two functions. In addition, since the electrical contact with the insulation-displacement contacts is established in the locking channels, any traction on the connection cable is not passed on at the insulation-displacement contacts, but instead at the locking fold which forms a stop for the folded-over wire. Folding over the wires prior to connecting them also makes it possible for the cap to be mounted on the base from the rear, which is easier than mounting it laterally.

In addition, in order to lock the wires permanently in their respective channels, the locking channels are provided with retaining means such as lugs for holding the locked wires in their respective channels. The edges on which the locking folds are formed already make it possible to lock the wires, but the retaining means, e.g. in the form of lugs, guarantee that the conductor wires are held stationary permanently in the channels, so that any traction exerted on the cable cannot give rise to the conductor wires being disengaged from their respective channels.

In a practical embodiment, the common guide ducts are open laterally so as to enable the pairs of wires to be inserted laterally into them. As a result, it is not necessary to thread the pairs of wires into their respective pair guides, but rather they can simply be engaged laterally therein, which greatly facilitates inserting the pairs into the guides. In which case, the wire pair guides are in the form of notches in the organizer cap, each of which notches opens out at its bottom end in the two respective locking channels. The operator in charge of wiring then merely needs to organize the four pairs of wires in three dimensions in four divergent directions, to bring the cable end arranged in this way over the organizer cap, and then to push the four pairs of wires one-by-one into the laterally-open guides. Then the operator merely needs to fold over the conductor wires by pulling them into their respective locking channels. The final operation consists merely in mounting the organizer cap on the rear of the outlet base and in pushing it therein until the conductor wires are engaged in the insulation-displacement contacts.

According to another characteristic, the wire guides are isolated electromagnetically from one another by a cross-shaped screening device which extends beyond the electrical contact between the wires and the outlet base. This characteristic is particularly advantageous when connection cables are used in which each pair of wires is shielded with a metal screen. Thus, the electromagnetic screens separating the various guides make it possible to provide excellent guide-to-guide isolation by extending the isolation provided by the screens on the pairs. In which case, it is particularly advisable to pull the pairs of screened cables as far as possible into the pair guides so as to avoid giving rise to any interruption in the isolation. This operation is particularly simple to perform with the organizer cap of the invention, because it is possible to pull the wires strongly through the common guide duct and then to fold them over the edges into their respective locking channels. The wires are thus locked firmly in their permanent positions so that slackening of the conductor wires does not give rise to any displacement of said wires in the organizer cap. In another practical embodiment, the base is provided with insulation-displacement contacts connected electrically to the contact pins, each locking channel is provided with a through housing enabling the insulation-displacement contact to be inserted transversely to the wires locked in their respective channels. The fact that the electrical contact is established at the those sections of the wires which are situated in the locking channels guarantees a certain amount of independence from the connection cable, in that any traction on the cable is exerted only at the locking fold and not at the insulation-displacement contacts.

In another aspect of the invention, the cap is provided with a drain wire guide that enables the drain wire to be grounded on fixing the cap to the base. Thus, in the same way as the conductor wire guides, the drain wire guide makes it possible, in the same operation of fixing the cap to the base, to put the drain wire in contact with a ground-forming metal or metal-plated portion.

Other characteristics and advantages of the invention appear more clearly from the following detailed description given with reference to the accompanying drawings which show embodiments of the present invention by way of non-limiting example.

Figure 2:
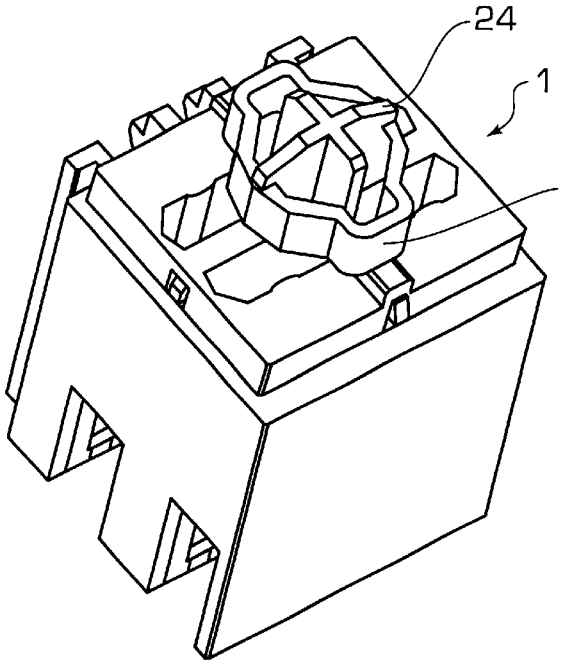
FIG. 2 is a view of the low-current outlet of FIG. 1, shown in the assembled state.
Figure 1:
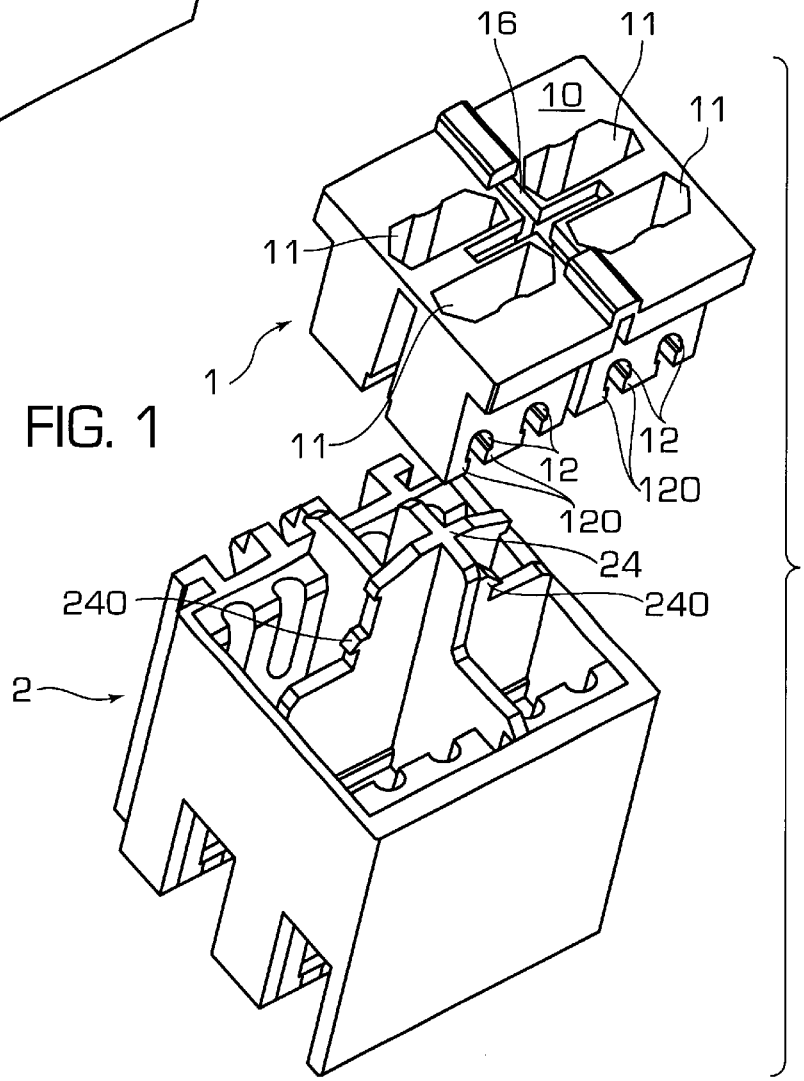
FIG. 1 is an exploded perspective view of an embodiment of a low-current outlet of the present invention.
Figure 4:
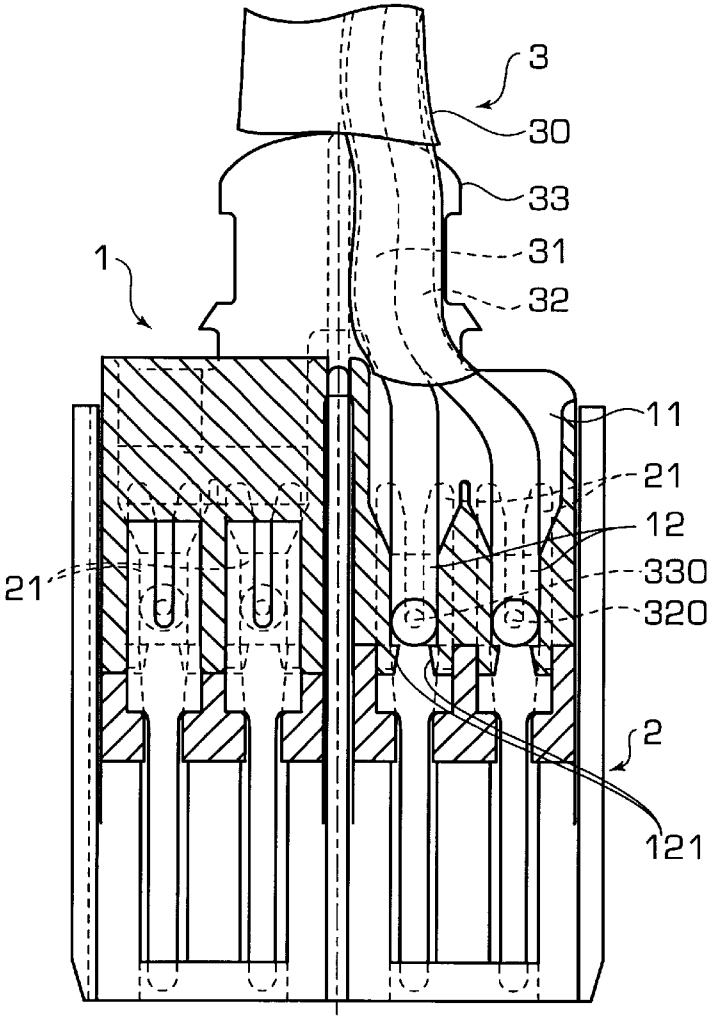
FIG. 4 is a cross-section view of the outlet of FIG. 3, shown in the assembled state.
Figure 3:
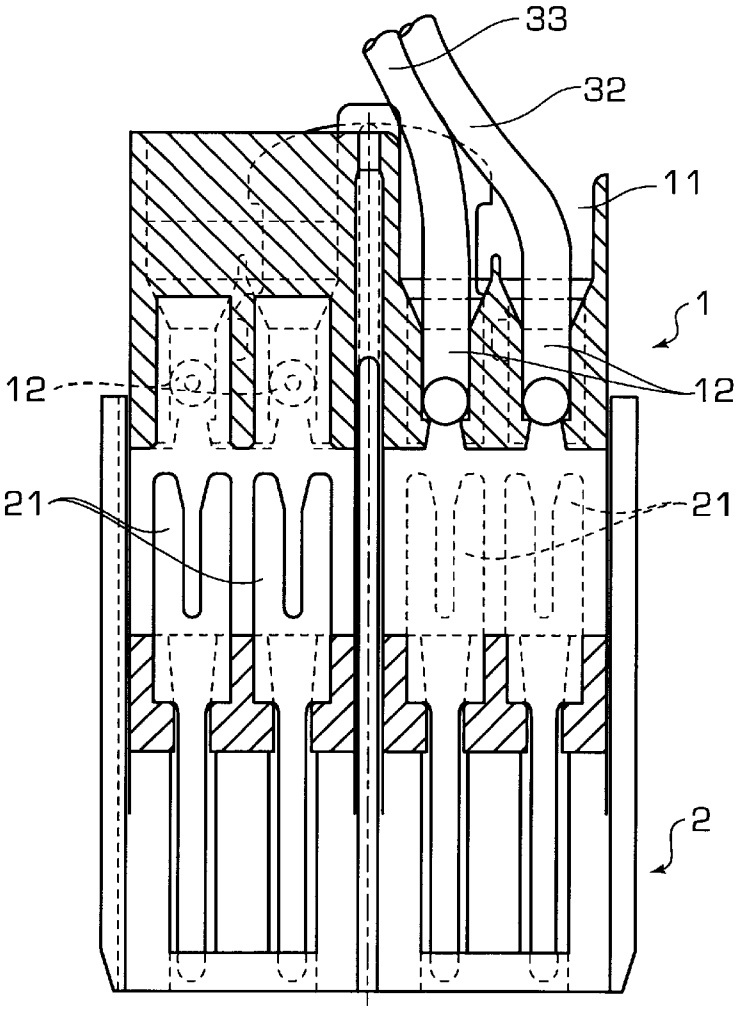
FIG. 3 is an exploded cross-section view of the low-current outlet of FIGS. 1 and 2.

Reference is made initially to FIGS. 1 to 4, to explain a first embodiment of a low-current outlet of the invention. As can be seen in the exploded view in FIG. 1, the low-current outlet essentially comprises two component parts, namely an outlet base 2 and a rear organizer cap 1. Both of the parts 1 and 2 may be made of molded plastic. As shown in FIGS. 1 and 2, the front face of the base 2 faces downwards and is provided with a pluggable socket in which contact pins 25 are disposed, such as the contact pins shown in FIGS. 5 and 6, it being possible to connect a plug to the contact pins along a given plug-in axis. In general, in an RJ45-type outlet, there are eight contact pins 25. Each contact pin 25 is connected electrically to a respective insulation-displacement contact 21, as shown in FIGS. 3 and 4. The insulation-displacement contacts 21 are accessible from the rear of the base 2 when the rear cap 1 is removed, and they extend along the plug-in axis. As shown in FIGS. 1 and 2, the rear face of the base 3 faces upwards. An object of the rear organizer cap 1 is to engage the individual conductor wires of a connection cable 3 in the respective insulation-displacement contacts 21 of the outlet base 2. In the embodiment shown in FIGS. 1 to 4, the outlet base 2 is provided with a cross-shaped screen element 24 which subdivides the outlet base 2 into four compartments that are well isolated electromagnetically from one another. Advantageously, the screen 24 may be made of a metal such as Zamak (a zinc alloy). Each compartment defined by the screen 24 contains two insulation-displacement contacts 21. In the example used for the description, an eight-pin outlet base is chosen, the outlet base thus having eight insulation-displacement contacts 21, but it is also possible to provide low-current outlets with more than or with less than eight contact pins. The number of insulation-displacement contact pins should not be considered to be limiting to the invention. The outlet base 2 described above is common to both of the embodiments shown in the figures, except for the screen 24.

The organizer cap 1 may be mounted on the rear of the outlet base 2, e.g. by snap-fastening. For this purpose, the screen 24 is provided with snap-fastening catches 240 which enable the rear cap 1 to be fixed permanently to the outlet base 2. Optionally, in order to hold the organizer on the base 2 firmly and immovably, a holding ring 25 may be provided, which ring snap-fastens onto the screen 24 while bearing against the cap 1.

The rear organizer cap 1 has a cross-sectional area that is somewhat smaller than the cross-sectional area of the outlet base 2, so that the cap can be inserted into the base 2. In the example shown in FIGS. 1 to 4, in which a screen 24 is implemented, the organizer cap 1 is provided with a central insertion passageway 16 allowing the cross-shaped top portion of the screen 24 to pass through it. In the assembled state, the snap-fastening catches 240 on the screen 24 bear against the top face 10 of the cap 1 at the ends of the cross-shaped passageway 16. Permanent fixing is thus obtained.

Figure 6:
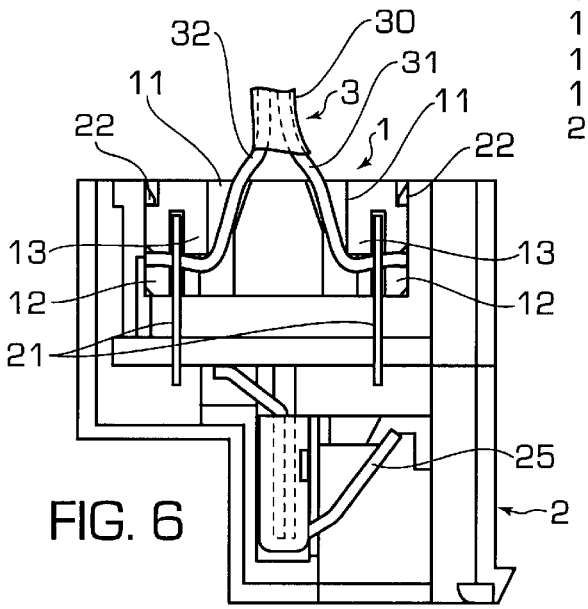
FIG. 6 is a cross-section view of the low-current outlet of FIG. 5, shown in the assembled state.
Figure 5:
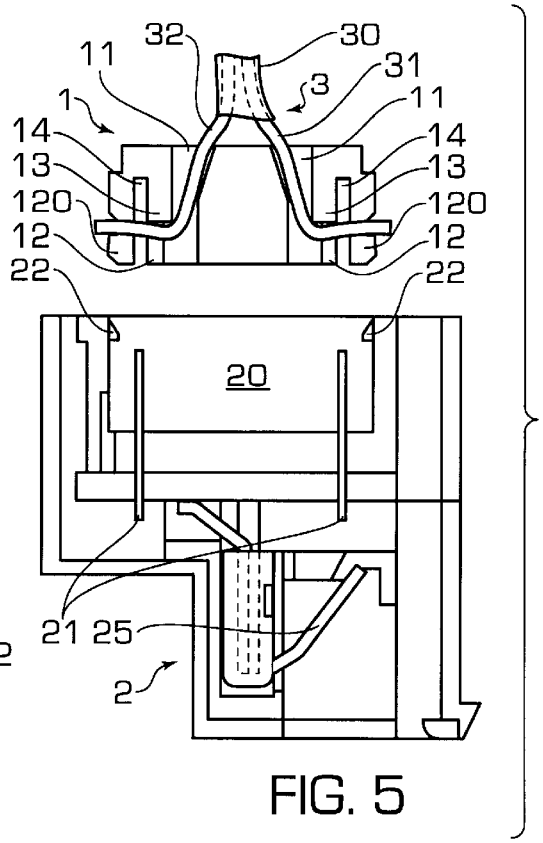
FIG. 5 is an exploded cross-section view of another embodiment of a low-current outlet.

According to an advantageous characteristic of the invention, the organizer cap 1 is provided with four wire-pair guides 11 disposed relative to one another in a manner such as to form a rectangle. Each guide 11 corresponds to a compartment in the base 2 as defined by the screen 24. It can be seen that each wire-pair guide 11 has an elongate section, enabling a pair of wires disposed side-by-side to be inserted through it. Those portions of each the guide 11 which are visible from the face 10 of the cap 1 constitute a common guide duct 11 enabling a pair of wires 31, 32 to pass through it. The common guide duct 11 passes through the cap 1 from the surface 10 to the other side. It is thus possible to pass the wire pairs 31, 32 separately through the cap 1 by engaging them respectively in their respective guide ducts 11. The fact that the common guide ducts 11 are disposed in a polygonal geometrical configuration (a rectangular configuration in the present case) greatly facilitates the operation of inserting the wires through the organizer cap 1. Whereas in the prior art, it is essential to dispose the conductor wires in the same plane in a well aligned and ordered manner, by means of the organizer cap 1 of the invention, it is possible to organize them three-dimensionally in pairs and then to insert the pairs one-by-one into their respective common guide ducts 11. In this way, a considerable amount of time is saved when wiring the outlet. Once the four wire pairs 31, 32 have been inserted through the cap 1 by being engaged in the common guide ducts 11, the operator can pull on the wires to bring the shielding screen 30 of the cable 3 as close as possible to the cap 1. As shown in FIGS. 3 and 4, if each pair of wires 31, 32 is individually isolated by a screen 33, it is possible to pull on the wires on the other side of the cap 1 so as to cause the shielding screen 33 of the each of the individual pairs to penetrate at least in part into the respective common guide duct 11. Since the outlet base 2 is provided with an isolating screen 24, there is no interruption in the isolation between the cable 3 and the outlet of the invention. As can be seen in FIG. 4, the shielding screen 30 of the cable 3 is pulled until it comes into contact with the top portion of the screen 24 while the shielding screens 33 of the respective pairs penetrate into the common guide ducts 11. It is then possible to fold over the conductors individually so as to engage them individually into locking channels 12 which extend perpendicularly to the guide channels 11 and which are open over their lengths to the front of the cap, as can be seen in FIG. 1. Thus, each guide duct 11 opens out laterally into two locking channels 12. It can be understood from FIG. 1 that four locking channels 12 open out laterally on either side of the cap 1. With reference to FIGS. 5 and 6, it can be seen that, at the inlet of each of the locking channels 12, the cap 1 forms a projecting edge 13. Thus, when the operator folds over the individual wires into the locking channels 12, said wires are constrained to form locking folds at the edges 13. This locking fold on each of the conductor wires offers several advantages. Firstly, the folds make it possible to fix the position of the cable 3 permanently relative to the cap 1. In addition, the locking folds make it possible to bring the wires perpendicular to the insulation-displacement contacts 21. Furthermore, the locking folds make it possible to leave those portions of the wires which are engaged in the channels 12 substantially free from stress whenever traction is applied to the cable 3. Unlike the device of the prior art, in which the wires are merely engaged in the organizer cap and are free to slide therein, with the organizer cap of the invention, the wires are locked inside, which fixes the position of the cable 3 relative to the cap 1 permanently and immovably even before it is fixed to the base 2.

In order to prevent the sections of conductor wire from disengaging from the locking channels 12, said channels are provided with retaining means, e.g. in the form of retaining lugs 120 that, in each channel, define a through sectional area that is slightly smaller than the sectional area of each of the conductor wires so that, once they have been engaged under force into the locking channels 12, the conductor wires can no longer be disengaged therefrom. The locking fold formed on the edge 13 is thus permanently fixed in position. In addition, in order to enable the insulation-displacement contacts 21 to be engaged transversely onto the sections of conductor wire engaged in the locking channels 12, through insertion housings 14 are provided, which housings are disposed in a manner corresponding to the geometrical configuration of the insulation-displacement contacts 21.

With reference, for example, to FIGS. 3 and 4, or 5 and 6, a description follows of an operation of fixing an organizer cap 1 to a base 2. Once all of the conductor wires have been correctly installed in the organizer cap 1, as shown in FIG. 5, it is optionally possible to cut off the ends of the wires so that they do not extend beyond the cap 1. Then, it is necessary merely to mount the cap 1 from the rear into the socket 30 formed by the base 2 until the snap-fastening catches 22 on the base 2 snap-fasten to the organizer cap 1. Once this position has been reached (FIGS. 4 and 6), it is guaranteed that the conductor wires are properly engaged in the insulation-displacement contacts, thereby establishing the electrical contact with the contact pins 25. The low-current outlet of the invention is then operational.

Figure 7:
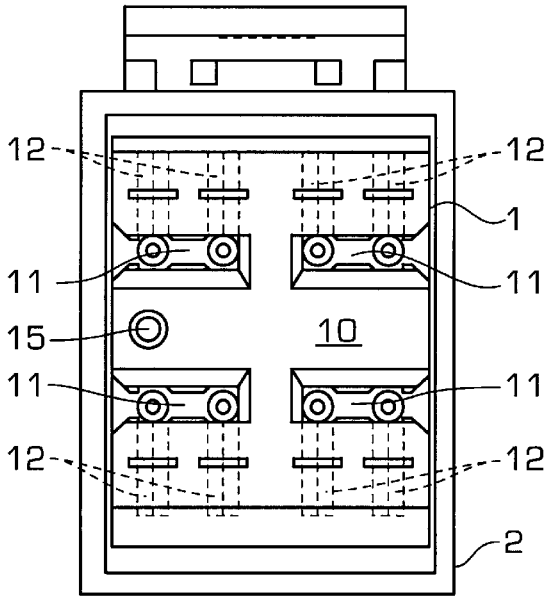
FIG. 7 is a plan view of the low-current outlet shown in FIGS. 5 and 6.

FIG. 7 shows a second embodiment of a low-current outlet of the invention. The variant incorporated in this second embodiment, lies in the design of the organizer cap 1, while the base 2 is identical except that it does not include an isolating screen 24 compartmentalizing the base 2 into four electromagnetically isolated spaces. The particularity incorporated in the organizer cap 1 shown in FIG. 7 lies in the fact that the common guide ducts 11 are open laterally so that it is possible to engage the pairs of wires laterally into the ducts 11. Whereas, in the first embodiment, it is necessary to insert the wires into the ducts 11 from the face 10 of the cap 1, with the cap 1 shown in FIG. 7, it is possible to engage them more simply by inserting them laterally. In addition, this type of cap 1 is provided with a drain wire guide 15 making it possible to connect the drain wire to ground on fixing the cap 1 to the base 2.

By means of the organizer cap 1 of the invention, it is possible to subdivide the cable 3 into pairs, and then consecutively to position the pairs of wires one after another, so that the wiring operation is much simpler. It should also be noted that the cap is placed on the base from the rear, which means that the locking folding of the wires withstands traction. In addition, the screen 24 makes it possible to isolate the pairs of wires to beyond the insulation-displacement contacts, which guarantees shielding continuity between pairs even if the shielding of the pairs disappears at the ducts.

What is claimed is:

1. A low-current outlet comprising:

an outlet base provided with contact pins to which a plug can be connected; and a rear cap that can be mounted on the rear of the outlet base, which cap, on being fixed to the base, establishes the electrical contact between conductor wires of a connection cable and the contact pins of the base, the cap being provided with wire-pair guides making it possible to position the wires so that they are connected electrically to the contact pins on fixing the cap to the base;

wherein each wire guide serves to guide one pair of wires, said guides being disposed in a polygonal geometrical configuration.

2. A low-current outlet comprising:

an outlet base provided with contact pins to which a plug can be connected; and a rear cap that can be mounted on the rear of the outlet base, which cap, on being fixed to the base, establishes the electrical contact between conductor wires of a connection cable and the contact pins of the base, the cap being provided with wire-pair guides making it possible to position the wires so that they are connected electrically to the contact pins on fixing the cap to the base;

wherein each wire-pair guide comprises a common guide duct that is common to the wires, and two locking channels for respective ones of the wires of the pair.

3. A low-current outlet according to claim 2, in which the common guide ducts extend substantially along said plug-in axis by passing through the cap, and the locking channels extend substantially perpendicularly to said plug-in axis over the front of the cap, while being open over their lengths.

4. A low-current outlet according to claim 2, in which the common guide duct and each of the two locking channels make an angle such as to form an edge on which the respective wires form locking folds.

5. A low-current outlet according to claim 2, in which the locking channels are provided with retaining means such as lugs for holding the locked wires in their respective channels.

6. A low-current outlet according to claim 2, in which the common guide ducts are open laterally so as to enable the pairs of wires to be inserted laterally into them.

7. A low-current outlet according to claim 2, in which the base is provided with insulation-displacement contacts connected electrically to the contact pins, each locking channel is provided with a through housing enabling the insulation-displacement contact to be inserted transversely to the wires locked in their respective channels.

8. A low-current outlet comprising:

an outlet base provided with contact pins to which a plug can be connected; and a rear cap that can be mounted on the rear of the outlet base, which cap, on being fixed to the base, establishes the electrical contact between conductor wires of a connection cable and the contact pins of the base, the cap being provided with wire-pair guides making it possible to position the wires so that they are connected electrically to the contact pins on fixing the cap to the base;

wherein the wire guides arc isolated electromagnetically from one another by a crossshaped screening device which extends beyond the electrical contact between the wires and the outlet base.

9. A low-current outlet comprising:

an outlet base provided with contact pins to which a plug can be connected; and a rear cap that can be mounted on the rear of the outlet base, which cap, on being fixed to the base, establishes the electrical contact between conductor wires of a connection cable and the contact pins of the base, the cap being provided with wire-pair guides making it possible to position the wires so that they arc connected electrically to the contact pins on fixing the cap to the base;

wherein the cap is provided with a drain wire guide that enables the drain wire to be grounded on fixing the cap to the base.

* * * * *

UNITED STATES PATENT AND TRADEMARK OFFICE

CERTIFICATE OF CORRECTION

PATENT NO. : 6,267,617 C1
APPLICATION NO. : 90/066239
DATED : October 26, 2004
INVENTOR(S) : Nozick, Jacques It is certified that error appears in the above-identified patent and that said Letters Patent is hereby corrected as shown below:

In the claims, column 1, line 25:

Please change "provide" to --provided--

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,267,617 C1
APPLICATION NO. : 90/006239
DATED : October 26, 2004
INVENTOR(S) : Jacques Nozick It is certified that error appears in the above-identified patent and that said Letters Patent is hereby corrected as shown below:

In the claims, column 1, line 25:

Please change "provide" to --provided--

This certificate supersedes Certificiate of Correction issued August 22, 2006.

Signed and Sealed this

Tenth Day of October, 2006

JON W. DUDAS
*Director of the United States Patent and Trademark Office*

US006267617C1

(12) EX PARTE REEXAMINATION CERTIFICATE (5006th)

United States Patent
Nozick

(10) Number: US 6,267,617 C1
(45) Certificate Issued: Oct. 26, 2004

(54) LOW VOLTAGE PLUG ADAPTER WITH ORGANIZING REAR BONNET

(75) Inventor: Jacques Nozick, Paris (FR)

(73) Assignee: Infra+, L'Hay les Roses (FR)

Reexamination Request:
No. 90/006,239, Mar. 7, 2002

Reexamination Certificate for:

| | |
|---|---|
| Patent No.: | **6,267,617** |
| Issued: | **Jul. 31, 2001** |
| Appl. No.: | **09/508,962** |
| Filed: | **May 19, 2000** |

(22) PCT Filed: Sep. 18, 1998

(86) PCT No.: PCT/FR98/02004

§ 371 (c)(1),
(2), (4) Date: May 19, 2000

(87) PCT Pub. No.: WO99/16153

PCT Pub. Date: Apr. 1, 1999

(30) Foreign Application Priority Data

Sep. 22, 1997 (FR) ..... 97 11763

(51) Int. Cl.[7] ..... H01R 4/24

(52) U.S. Cl. ..... 439/417; 439/676; 439/456; 439/404

(58) Field of Search ..... 439/417, 409, 439/456, 676, 395, 404

(56) References Cited

U.S. PATENT DOCUMENTS 5,605,469 A 2/1997 Wellinsky et al.
6,077,122 A 6/2000 Elkhatib

*Primary Examiner*—Gary V. Paumen

(57) ABSTRACT

The present invention relates to a low-current outlet comprising: an outlet base (2) provided with contact pins (25) to which a plug can be connected by engaging it along a given plug-in axis; and an organizer cap (1) that can be mounted on the outlet base (2), which cap (1), on being fixed to the base, establishes the electrical contract between the conductor wires (31, 32) of a connection cable (3) and the contact pins (25) of the base (2), the cap (1) being provided with wire guides (11, 12) making it possible to position the wires (31, 32) in three dimensions repetitively and separately so that they are connected electrically to the contact pins (25) on fixing the cap (1) to the base (2); said low-current outlet being characterized in that the cap (1) can be mounted onto the low-current outlet (2) from the rear and along said plug-in axis.

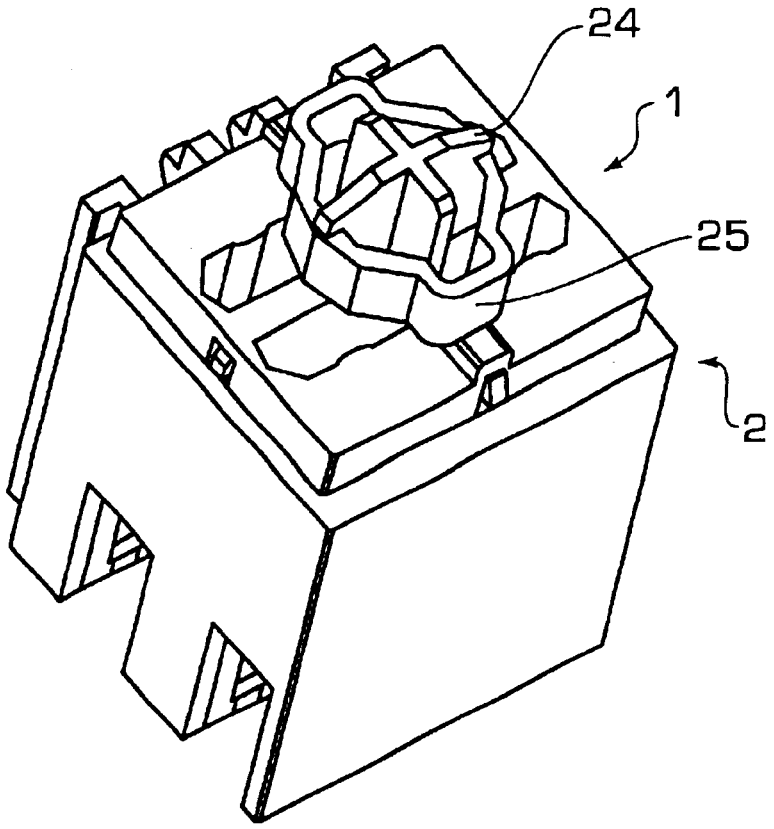

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2–9 is confirmed.

Claim 1 is cancelled.

New claims 10 and 11 are added and determined to be patentable.

*10. A low-current outlet comprising:*

*an outlet base provide with contact pins to which a plug can be connected; and*

*a rear cap that can be mounted on the rear of the outlet base, which cap, on being fixed to the base, establishes the electrical contact between conductor wires of a connection cable and the contact pins of the base, the cap being provided with wire-pair guides making it possible to position the wires so that they are connected electrically to the contact pins on fixing the cap to the base;*

*wherein each wire guide serves to guide one pair of wires, said guides being disposed in a polygonal geometrical configuration, and*

*in which each wire pair guide comprises a common guide duct enabling a pair of wires to pass through it.*

*11. A low-current outlet comprising:*

*an outlet base provided with contact pins to which a plug can be connected; and*

*a rear cap that can be mounted on the rear of the outlet base, which cap, on being fixed to the base, establishes the electrical contact between conductor wires of a connection cable and the cable contact pins of the base, the cap being provided with wire-pair guides making it possible to position the wires so that they are connected electrically to the contact pins on fixing the cap to the base;*

*wherein the wire guides are isolated electromagnetically from one another by a crossshaped screening device which extends beyond the electrical contact between the wires and the outlet base, and*

*wherein each wire-pair guide comprises a common guide duct that is common to the wires, and two-locking channels for respective ones of the wires of the pair.*

* * * * *